US008274560B2

(12) United States Patent
Galfrascoli et al.

(10) Patent No.: US 8,274,560 B2
(45) Date of Patent: Sep. 25, 2012

(54) FLAME DETECTOR FOR MONITORING A FLAME DURING A COMBUSTION PROCESS

(75) Inventors: Lorenzo Galfrascoli, Cairate (IT); Dacfey Dzung, Wettingen (CH); Matteo Venturino, Savona (IT); Olivier Steiger, Zurich (CH)

(73) Assignee: ABB Research Ltd, Zurich (CH)

( * ) Notice: Subject to any disclaimer, the term of this patent is extended or adjusted under 35 U.S.C. 154(b) by 827 days.

(21) Appl. No.: 12/403,118

(22) Filed: Mar. 12, 2009

(65) Prior Publication Data

US 2009/0191494 A1 Jul. 30, 2009

Related U.S. Application Data

(63) Continuation of application No. PCT/CH2006/000508, filed on Sep. 19, 2006.

(51) Int. Cl.
*H04N 7/18* (2006.01)

(52) U.S. Cl. ..... 348/83; 348/82; 110/185

(58) Field of Classification Search ..... 348/82, 348/83; 431/79, 12, 75; 110/188, 246, 185; 358/108; 65/485; 427/446; 148/195; 53/478; 60/274; 356/239.2; 505/445
See application file for complete search history.

(56) References Cited

U.S. PATENT DOCUMENTS 4,520,390 A * 5/1985 Paredes et al. ..... 505/445
4,620,491 A * 11/1986 Nishikawa et al. ..... 110/185
4,653,998 A * 3/1987 Sohma et al. ..... 431/79
4,756,684 A * 7/1988 Nishikawa et al. ..... 431/79
4,835,525 A 5/1989 Egi et al.
4,981,088 A 1/1991 Burris
5,249,954 A 10/1993 Allen et al.
5,547,369 A * 8/1996 Sohma et al. ..... 431/75
6,042,365 A * 3/2000 Chen ..... 431/12
6,142,665 A 11/2000 Haffner et al.
6,192,660 B1 * 2/2001 Moriyama et al. ..... 53/478
6,318,891 B1 11/2001 Haffner et al.
6,537,386 B1 * 3/2003 Detronde ..... 148/195
2001/0014436 A1 8/2001 Lemelson et al.
2001/0035952 A1 * 11/2001 Merklein ..... 356/239.2
2003/0159472 A1 * 8/2003 Nakahara et al. ..... 65/485
2004/0013813 A1 * 1/2004 Lugscheider ..... 427/446
2004/0237505 A1 * 12/2004 Leipertz ..... 60/274
2005/0147288 A1 7/2005 Wintrich et al.

(Continued)

FOREIGN PATENT DOCUMENTS

AU 686966 11/1997

(Continued)

OTHER PUBLICATIONS

Form PCT/ISA/210 (International Search Report) dated May 21, 2007.

(Continued)

*Primary Examiner* — Le H Luu
(74) *Attorney, Agent, or Firm* — Buchanan Ingersoll & Rooney PC

(57) ABSTRACT

A flame detector is disclosed for monitoring a flame during a combustion process, comprising a camera and a carrier tube, wherein the camera is arranged at a front end of the carrier tube such that an optical access of the camera is directed toward the flame when the front end of the carrier tube is mounted in the vicinity of a burner nozzle aperture.

19 Claims, 2 Drawing Sheets

U.S. PATENT DOCUMENTS

2005/0266363 A1 12/2005 Ganeshan

FOREIGN PATENT DOCUMENTS

| | | | |
|---|---|---|---|
| CN | 1461915 | A | 12/2003 |
| DE | 196 32 174 | A1 | 2/1998 |
| EP | 0 616 200 | A1 | 9/1994 |
| EP | 0 802 372 | A1 | 10/1997 |
| EP | 0 819 889 | A1 | 1/1998 |
| EP | 0 845 636 | A2 | 6/1998 |
| JP | 62-077517 | A | 4/1987 |
| WO | WO 2004/001940 | A1 | 3/2004 |

OTHER PUBLICATIONS

Form PCT/ISA/237 (Written Opinion of the International Searching Authority) dated May 21, 2007.

Form PCT/IPEA/409 (International Preliminary Report on Patentability) dated Dec. 16, 2008.

Notification of the First Office Action issued Mar. 19, 2010 in corresponding Chinese Application No. 200680055858.1.

* cited by examiner

FLAME DETECTOR FOR MONITORING A FLAME DURING A COMBUSTION PROCESS

RELATED APPLICATION

This application claims priority as a continuation application under 35 U.S.C. §120 to PCT/CH2006/000508 filed as an International Application on Sep. 19, 2006 designating the U.S., the entire content of which is hereby incorporated by reference in its entirety.

TECHNICAL FIELD

The disclosure relates to a flame detector for monitoring a flame during a combustion process. The expression "monitoring a flame" shall be understood as "monitoring at least one flame", the flame detector according to the disclosure may also be used for monitoring several flames simultaneously.

BACKGROUND INFORMATION

Flame detectors or flame scanners are devices which are used to determine the state of burners in industrial and utility furnaces. Such furnaces can be, for example, steam boilers, water heaters, or gas-, oil- or coal-fired furnaces. Flame detectors monitor one or several flames inside a furnace. In a conventional flame detector phototubes or photodiodes are used to detect the total light intensity of the flame which is received via some focussing optics.

FIG. 1 depicts a state-of-the-art flame detector 1 that is mounted on a burner 2. The burner 2 has a tapered burner nozzle 3 with vanes 4 on its outside. Fuel (black arrow) and air (white arrow) are led though or alongside the burner 2 into a non-depicted furnace. One version of a known flame detector 1 consists of a carrier tube 5 and a photo element in form of a photodiode 6 that is mounted at a front end of the carrier tube 5. The front end of the carrier tube 5 is located at the aperture of the burner nozzle 3 which is directed toward the inside of the furnace i.e. toward the combustion chamber. The tube also carries cooling air to the photodiode 6 and includes cables for the power supply of the photo element 6 and for transmitting the data signals recorded by the photodiode 6.

Another known flame detector 1 comprises at the front end of the tube 5 instead of a photodiode a lens 7 that focuses the light of the flame inside the furnace onto a fiber optic cable that is located inside the carrier tube 5. In this case, a photo element is located at the rear end of the carrier tube 5 in a separate casing. The photo element receives the light from the flame via other lens 7 and the fiber optic cable. The casing of the photo element is mounted at the outside of the furnace where ambient temperatures prevail. A signal conditioning unit is provided inside the casing of the photo element. From the signal conditioning unit the data signals are transmitted via wires to flame detection modules and further to a burner/boiler management system (BMS).

Phototubes comprising a tube and a photo element, in particular a photodiode, or a lens mounted at the front end of the tube may, however, require a precise line-of-sight for flame evaluation.

From patent application US 2005/0266363 A1 it is also known to collect and transmit light from several flames by use of optical fibers, to insect the collected light by a video camera vision system at the other end of the optical fibers and to transmit the "life" images of the glows of the flames as well as the "on/off" status of the burners to a control room.

From patent application DE 196 32 174 A1 a device for measuring the temperature of a flame, in particular a flame inside a combustion chamber of a gas turbine, is known that comprises an optical sensor fiber that is directed toward the flame and connected to a spectrograph for analyzing the spectral composition of the flame image.

From patent documents EP 0 616 200 B1 and US 2001/0014436 A1 it is known to employ cameras or other scanning devices for monitoring flames in furnaces. According to the patent document U.S. Pat. No. 5,249,954 A a camera is mounted at the rear end of a sight tube which extends through a windbox into the furnace. Hence, the camera views the flame through the sight tube. Soot from the flame may, however, cover the front end of the sight tube or an observation window behind which the camera is positioned which may lead to degradation of the flame detection capability of the camera.

Feasible flame detectors have, furthermore, to be constructed such that they can withstand high temperatures, flame temperatures usually being around 1500° C. and the wall temperatures of the furnace walls usually being around several hundred degrees Celsius.

SUMMARY

Exemplary embodiments disclosed herein are directed to a flame detector for monitoring a flame during a combustion process by which the above-mentioned problems can be avoided.

A flame detector arrangement for monitoring a flame during a combustion process is disclosed, comprising a camera, a carrier tube and a tilting burner nozzle, wherein the carrier tube is constructed such that it can carry a cooling medium to the camera, wherein the camera is arranged at a front end of the carrier tube and the front end of the carrier tube is mounted in the vicinity of the burner nozzle aperture such that an optical access of the camera is directed toward the flame wherein the carrier tube is flexible so that it can be connected to the tilting burner nozzle.

In another aspect, a system is disclosed for monitoring a flame based on a tilting burner nozzle. Such a system comprises configuring a carrier tube to carry a cooling medium to a camera; arranging the camera at a front end of the carrier tube; and mounting the front end of the carrier tube in the vicinity of an aperture of the burner nozzle such that an optical access of the camera is directed toward the flame. The carrier tube is flexible so that it can be connected to the tilting burner nozzle.

BRIEF DESCRIPTION OF THE DRAWINGS

Further advantageous features and applications of the disclosure can be found in the following description and the drawings illustrating the disclosure. In the drawings like reference signs designate the same or similar parts throughout the several features of which.

DETAILED DESCRIPTION

Figure 1:
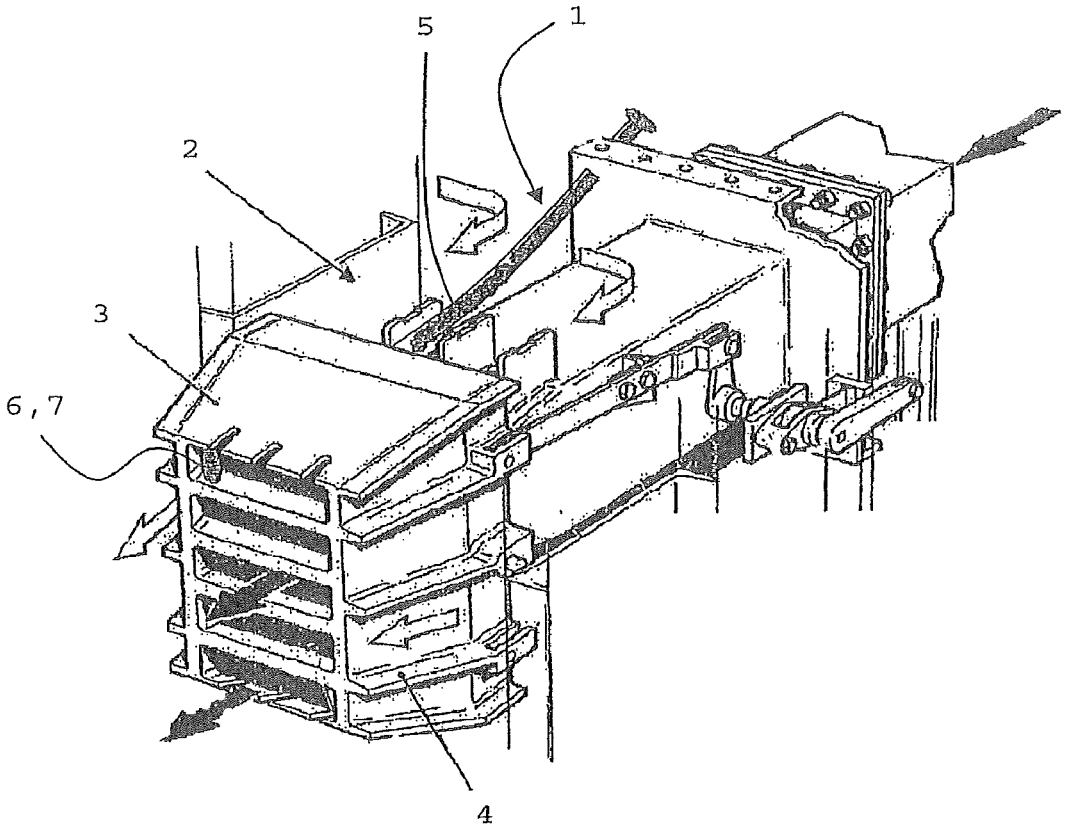
Prior Art Fig.1
FIG. 1 shows a perspective view of a burner with a flame detector arranged at the burner.

A flame detector for monitoring a flame during a combustion process is provided that comprises a camera and a carrier tube, wherein the camera is arranged at the front end of the carrier tube such that an optical access of the camera is directed toward the flame when the front end of the carrier tube is mounted in the vicinity of a burner nozzle aperture.

The burner nozzle aperture is defined as that aperture of the burner nozzle that is directed toward a flame inside the furnace. The optical access of a camera preferably comprises optics in the form of one or several lenses.

By using a camera, in particular a CCD-(charge-coupled-device) or a CMOS (complementary-symmetry-metal-oxide-semiconductor) camera or any other type of electronic camera, flame images with a wide field of view can be provided. A flame detector according to the disclosure can be easily implemented into a furnace or a burner, respectively, by re-using the carrier tube of a flame detector according to the state of the art (confer FIG. 1) and exchanging the photodiode or lens at the front end of the carrier tube with such a camera. This facilitates the retrofit and replacement of conventional flame detectors by image-based flame detectors with cameras that provide improved performance. The known mounting procedure with the carrier tubes can be easily applied to the flame detector according to the disclosure that comprises a camera. Each photodiode/lens of a conventional flame detector can be replaced by a camera leading to a flame detector according to the disclosure.

According to a first aspect of the disclosure the carrier tube is constructed such that it can carry a cooling medium to the camera, the cooling medium being, e.g., cooling air. The provision of cooling medium is preferentially such that the camera and, where appropriate, integrated imaging electronics or electronic circuits can be kept at a temperature below 100° C. This allows the camera and the imaging electronics to operate reliably.

According to a further aspect of the disclosure the carrier tube provides for a power supply for the camera. Furthermore, the carrier tube can include one or several data cables for transmitting data recorded by the camera to a rear end of the carrier tube. As data cables copper wires or optical fibers that are usually employed for telecommunication applications can be used. From the rear end of the carrier tube the data can be further transmitted to one or several signal processing units and/or to a burner/boiler management system by corresponding data cables.

According to a further aspect of the disclosure the tube is flexible, in particular mechanically flexible, so that it can be connected to a tilting burner nozzle whose tilt is adjustable in order to control furnace/boiler conditions during the combustion process. The connection between the carrier tube and the burner nozzle can be accomplished by welding the front end of the carrier tube to the burner nozzle, in particular to the burner nozzle aperture.

The imaging electronics or electronic circuits for processing the data output of the camera can be integrated with the camera at the front end of the carrier tube. Processed data (e.g. comprising compressed images of a flame) are then transmitted over a the data cable to the rear end of the carrier tube and may be transmitted further to a burner/boiler management system without requiring any further intervening signal processing unit, therefore rendering flame monitoring rather cost-efficient.

Alternatively, non-processed data output from the camera is transmitted over a data cable, e.g., a high capacity data link, through the carrier tube to a signal processing unit for processing, the signal processing unit being mounted, e.g., at the outside of the furnace. Imaging electronics form part of the signal processing unit. This allows the implementation of signal processing units with high complexity image processing systems as there are less space and temperature constraints.

FIG. 1 shows a burner with a flame detector 1 as described above.

Figure 2:
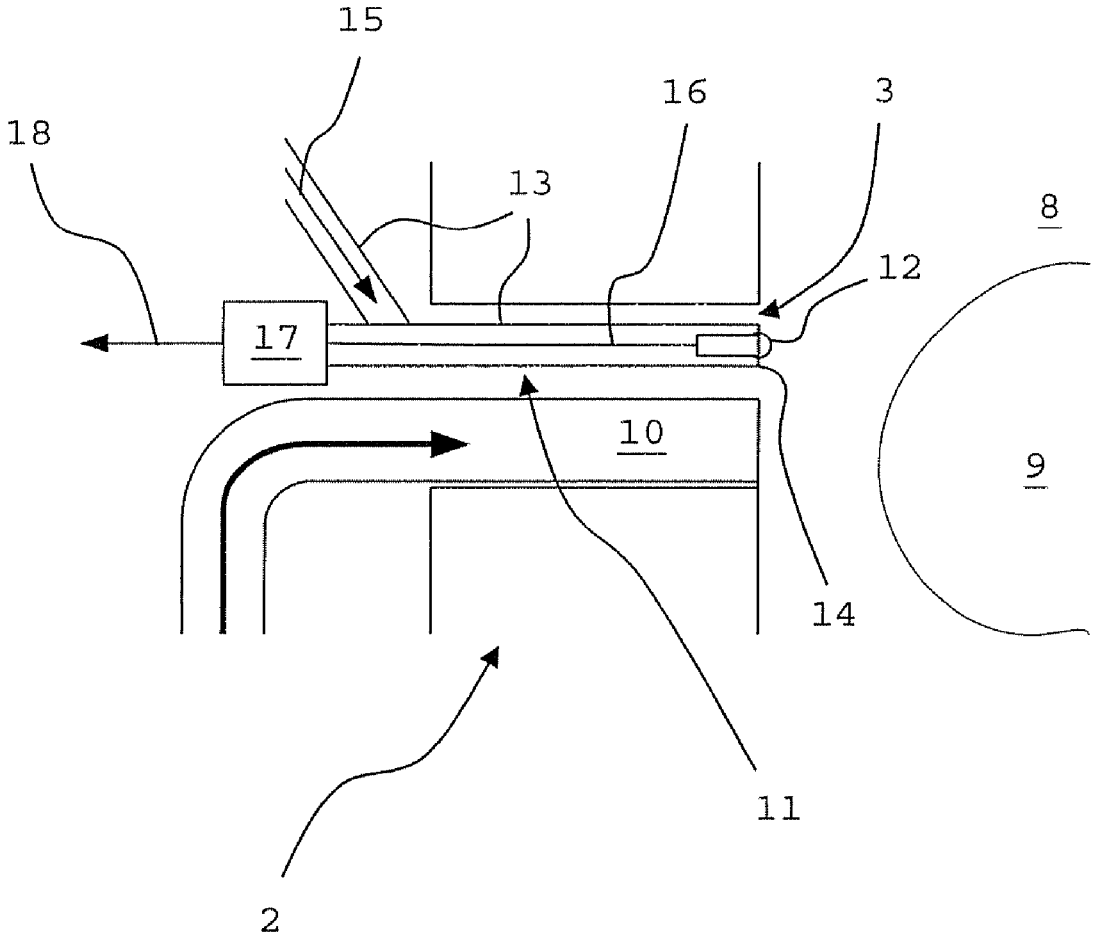
FIG. 2 depicts a schematic diagram of an exemplary burner with a flame detector according to the disclosure.

FIG. 2 shows an exemplary burner 2 with a flame detector according to the disclosure. Such a burner 2 comprises a burner nozzle 3 with the burner nozzle aperture being directed at the inside of a furnace 8. During combustion process at least one flame 9 is burning inside the furnace 8. The burner 2 comprises conduits 10 for delivering fuel and air into the furnace 8.

A flame detector 11 is assigned to the burner 2. The flame detector 11 comprises a camera 12 and a carrier tube 13. The camera 12 is mounted a front end 14 of the carrier tube 13 and is directed at the inside of the furnace 8, that is the camera 12 is directed at a flame 9. The front end 14 of the carrier tube 12 is mounted in the vicinity of the burner nozzle aperture, the aperture being toward the inside of the furnace 8. The front end 14 of the carrier tube 13 can be mounted at the burner nozzle, e.g., at the burner nozzle aperture.

The carrier tube 13 provides for a power supply for the camera 12 and carries cooling air 15 towards the camera 12. Furthermore, the carrier tube 13 includes a data cable 16 for transmitting data recorded by the camera 12 toward a signal processing unit 17 from which the processed data can be further transmitted via a data cable 18 toward a non-depicted burner/boiler management system.

The carrier tube 13 can comprise several branches, cooling air 15 being transmitted through one branch and data from the camera being transmitted through another branch for example.

The camera 12 may be provided with a non-depicted shutter in front of the camera 12 i.e. in front of a camera lens or camera optics, respectively, for performing a self-check, in particular a periodic self-check. For opening or closing the shutter a pneumatic mechanism can be arranged for.

The camera 12 comprises non-displayed optics for forming an image of the flame 9. The optics includes a lens to cover the desired field of view. Of course, the optics can comprise several lenses. Furthermore, the optics can contain image splitters and/or wavelengths filters for obtaining flame images at different predetermined optical wavelengths. The image splitters can be in the form of lenses that are arranged side by side. A wavelength filter can be assigned to each image splitter, the wavelength filters also being arranged side by side. The wavelength filters can, for example, comprise a UV-band filter passing ultraviolet light and blocking visible infrared light, a VIS-band filter passing visible light and blocking ultraviolet and infrared light, and an IR-band filter passing infrared light and blocking visible and ultraviolet light. The camera 12 can output grey level images for each of the selected wavelength at a pre-defined frame rate.

It is to be understood that while certain embodiments of the present disclosure have been illustrated and described herein, it is not to be limited to the specific embodiments described and shown.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF REFERENCE NUMERALS

1: state-of-the-art flame detector
2: burner
3: burner nozzle
4: vane
5: carrier tube
6: photodiode
7: lens
8: furnace; combustion chamber
9: flame
10: conduits for air and fuel
11: flame detector according to the invention
12: camera
13: carrier tube
14: front end of the carrier tube
15: cooling air
16: data cable
17: signal processing unit
18: data cable

What is claimed is:

1. A flame detector arrangement for monitoring a flame during a combustion process in a furnace, comprising:

a tilting burner nozzle having a burner nozzle aperture;

a flexible carrier tube connected to the tilting burner nozzle and mounted in a vicinity of the burner nozzle aperture;

a camera arranged at a front end of the carrier tube such that an optical axis of the camera is directed toward the flame, wherein the carrier tube includes a branch for carrying a cooling medium to the camera, the carrier tube and the camera being tiltable with the tilting burner nozzle.

2. The flame detector according to claim 1, wherein the carrier tube provides for a power supply to the camera.

3. The flame detector according to claim 2, wherein the carrier tube includes a data cable for transmitting data recorded by the camera to a rear end of the carrier tube.

4. The flame detector according to claim 2, wherein the camera is provided with a shutter.

5. The flame detector according to claim 2, wherein imaging electronics are integrated with the camera at the front end of the carrier tube.

6. The flame detector according to claim 2, wherein the camera is a CCD- or a CMOS-camera.

7. The flame detector according to claim 1, wherein the carrier tube includes a data cable for transmitting data recorded by the camera to a rear end of the carrier tube.

8. The flame detector according to claim 7, wherein the camera is provided with a shutter.

9. The flame detector according to claim 7, wherein imaging electronics are integrated with the camera at the front end of the carrier tube.

10. The flame detector according to claim 7, wherein the camera is a CCD- or a CMOS-camera.

11. The flame detector according to claim 1, wherein the camera is provided with a shutter.

12. The flame detector according to claim 11, wherein imaging electronics are integrated with the camera at the front end of the carrier tube.

13. The flame detector according to claim 11, wherein the camera is a CCD- or a CMOS-camera.

14. The flame detector according to claim 1, wherein imaging electronics are integrated with the camera at the front end of the carrier tube.

15. The flame detector according to claim 14, wherein the camera is a CCD- or a CMOS-camera.

16. The flame detector according to claim 1, wherein the camera is a CCD- or a CMOS-camera.

17. The flame detector according to claim 16, comprising:

electronics for processing the data output of the camera.

18. A method for monitoring a flame in a furnace including a tilting burner nozzle, the method comprising:

configuring a carrier tube to carry a cooling medium to a camera;

arranging the camera at a front end of the carrier tube; and mounting the front end of the carrier tube in a vicinity of an aperture of the burner nozzle such that an optical axis of the camera is directed toward the flame, wherein the carrier tube is flexible so that it can be connected to the tilting burner nozzle, so that the carrier tube and the camera arranged at the front end of the carrier tube are tiltable with the tilting burner nozzle.

19. The method for monitoring flame according to claim 18, comprising:

processing the data output of the camera using electronics.

* * * * *